United States Patent [19]

De Fonzo et al.

[11] 4,263,570

[45] Apr. 21, 1981

[54] OPTICAL PHASE SHIFTER

[75] Inventors: Alfred P. De Fonzo, Alexandria; Thomas G. Giallorenzi, Springfield, both of Va.

[73] Assignee: The United States of America as represented by the Secretary of the Navy, Washington, D.C.

[21] Appl. No.: 954,376

[22] Filed: Oct. 24, 1978

[51] Int. Cl.[3] ..... H01P 1/18; H01P 9/00; H01P 3/00

[52] U.S. Cl. ..... 333/157; 333/164; 333/248; 357/30

[58] Field of Search ..... 333/156, 152, 248, 253, 333/246, 247, 245, 250, 263, 157, 81 B, 164; 332/2, 3, 16 R, 16 T, 29 R, 52; 357/30; 307/311

[56] References Cited

U.S. PATENT DOCUMENTS

| | | | |
|---|---|---|---|
| 3,040,262 | 6/1962 | Pearson | 307/311 X |
| 3,721,923 | 3/1973 | Gray et al. | 333/157 |
| 3,866,143 | 2/1975 | Jacobs et al. | 333/164 X |
| 3,944,950 | 3/1976 | Jacobs et al. | 333/164 |

FOREIGN PATENT DOCUMENTS

| | | | |
|---|---|---|---|
| 627602 | 9/1961 | Canada | 333/248 |

*Primary Examiner*—Marvin L. Nussbaum
*Attorney, Agent, or Firm*—R. S. Sciascia; William T. Ellis; Vincent J. Ranucci

[57] ABSTRACT

A reciprocal phase shifter for optically controlling the phase of microwave, millimeter, and submillimeter wavelength electromagnetic energy includes a source of light and a waveguide which comprises an interaction material for absorbing the light and forming a plasma of electron-hole pairs within the material. The plasma interacts with a traveling wave in the waveguide. The speed at which the wave propagates changes in the interaction region and thereby changes the phase of the wave.

13 Claims, 3 Drawing Figures

OPTICAL PHASE SHIFTER

BACKGROUND OF THE INVENTION

This invention relates to a phase shifter for electromagnetic traveling waves and especially to an optically variable phase shifter for traveling waves of microwave, millimeter and submillimeter wavelengths.

Conventional phase shifters are electrically variable, that is, the control signal applied to the phase-shifter is electrical. The most common phase shifters use ferrite, diodes or PIN semiconductors as an interaction material to induce phase shifting.

The operation of the ferrite phase shifter is dependent upon the interaction between a slab of ferrite material and a magnetic biasing field for its phase shifting effect. However, the relatively high attenuation of microwave signals by ferrite material at millimeter wavelengths has precluded this method of phase shifting in this frequency range.

The diode phase shifters employ one or more diodes mounted inside a waveguide. The diodes are responsive to a D.C. bias voltage applied across the diode electrodes. The field produced by the bias voltage induces a change in the electrical characteristics of the diode, which in turn affects the microwave impedance at various points within the waveguide. The change in impedance causes a change in phase shift in a microwave signal transmitted through the waveguide. At millimeter wavelength frequencies, the internal dimensions of the waveguide are relatively small so that accurate positioning of a diode is a problem. Also, the attenuation of a microwave signal by a variable reactance diode increases with increasing frequency.

A PIN semiconductor phase shifter is a slab of variable-conductivity semiconductor material in contact with substantially the entire surface area of one of the internal narrow-dimensioned waveguide walls. The microwave conductivity of the semiconductive slab is responsive to the polarity of a D.C. bias voltage applied across the slab electrodes. The polarity of the applied bias voltage changes the conductivity of the slab and causes the phase-determining broad wall dimension of the waveguide to electrically change.

These conventional phase shifters require the application of an electrical signal by either inductive coupling, such as by coils, to the ferrite, or by wiring to the diode or PIN semiconductor. Such applications require structures and circuitry, some of which must be attached to the interaction material and which may cause spurious interference and insertion loss to the phase shifting performance. The circuitry typically includes isolation networks to prevent such interference. The structures and circuitry are costly and may be inconvenient for specific applications where space is limited.

The response time, that is, the time for the traveling wave to shift in phase in response to the electrical signal applied to the phase shifter, is slow for conventional phase shifters because the response time is dependent on the medium which conducts the electrical signal. The response time for the PIN semiconductor phase shifter is further dependent on the traversal of electron-hole pairs across its entire intrinsic region.

SUMMARY OF THE INVENTION

It is the general purpose and object of the present invention to optically control the shift in phase of waves propagating at microwave, millimeter and submillimeter wavelength frequencies.

This and other objects of the present invention are accomplished by a source of light and a waveguide comprising an interaction material which absorbs the light from the source and which forms a plasma of electron-hole pairs within that portion of the material upon which the light strikes. The plasma alters the wave number of a traveling wave, which propagates in the waveguide, in the region of illumination wherein the speed at which a wave propagates changes and thereby changes the phase of the wave.

The present invention is advantageous because the control signal applied to the phase shifter is optical and not electrical. A medium such as air conducts the optical control signal and, therefore, no electrical structures, circuitry or isolation networks must be attached to the interaction material. The traveling wave interacts with only the electron-hole pairs and not with the light. Thus, the isolation between the source of the optical signal and the waveguide is nearly infinite so that interferences and insertion losses are very low. Also, the amount of interaction material required for phase shifting may be small compared to the size of the waveguide. The low insertion losses and compactness of the present invention are particularly applicable to low millimeter wavelength systems.

The response time of the optical phase shifter is much faster than that of conventional phase shifters because the optical control signal is intrinsically faster than microwaves. Optical injection of electron-hole pairs occurs simultaneously over the illuminated portion of the interaction material. Thus, the only factor which limits the response time of the optical phase-shifter is the response time of the waveguide. A faster response time enables more information to be processed by the system which utilizes the present invention.

The optical phase-shifter is economical, compact, efficient and convenient compared to conventional phase-shifters.

DETAILED DESCRIPTION OF THE INVENTION

Figure 1:
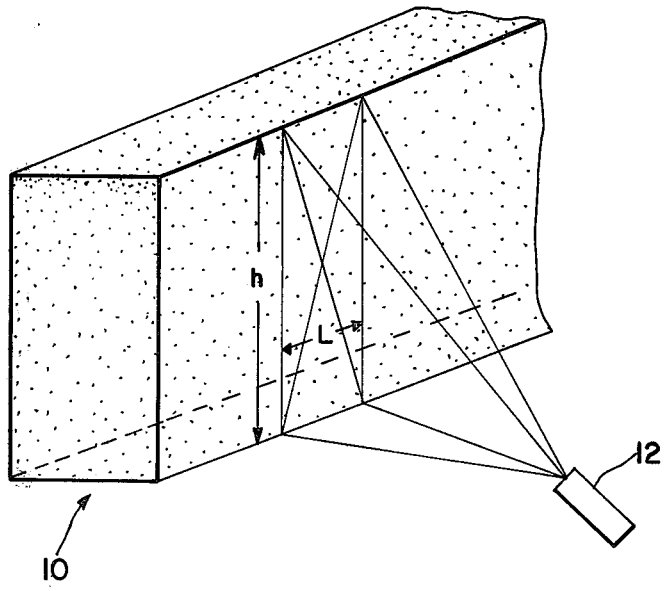
FIGS. 1–3 are isometric illustrations of three embodiments of the present invention.

Referring now to the drawings, wherein like reference characters designate like or corresponding parts throughout the several views, FIG. 1 shows a solid dielectric waveguide 10, preferably having broad and narrow wall dimensions, formed from an interaction material which will be more fully described hereinafter, and a source 12 of light which illuminates preferably a broad-dimensioned wall of the waveguide.

Figure 2:
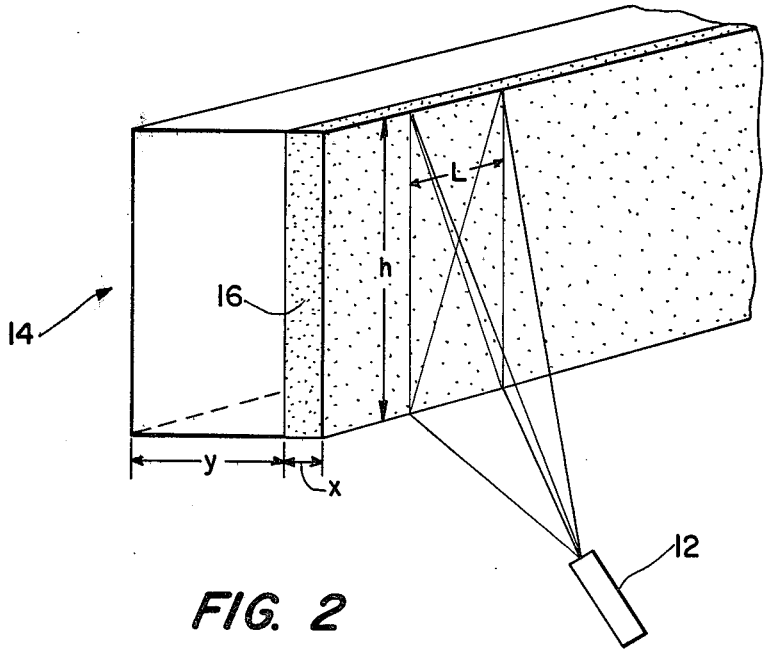

FIG. 2 illustrates a second embodiment of the present invention which includes a dielectric waveguide 14, preferably having broad and narrow wall dimensions, and having a film 16 of interaction material on the external side of preferably a broad-dimensioned wall of the waveguide, and a source 12 of light. In this embodiment the waveguide 14 is fabricated from a dielectric material which is different from the interaction material of the film 16. However, the permittivity of the dielectric waveguide 14 must be approximately the same as the permittivity of the film 16. Light from the source 12 strikes the film 16. The thickness x of the film 16 is small in comparison to the thickness y of the waveguide 14, that is, $x \leqq y/10$, and may be adjusted for optimum performance.

Figure 3:
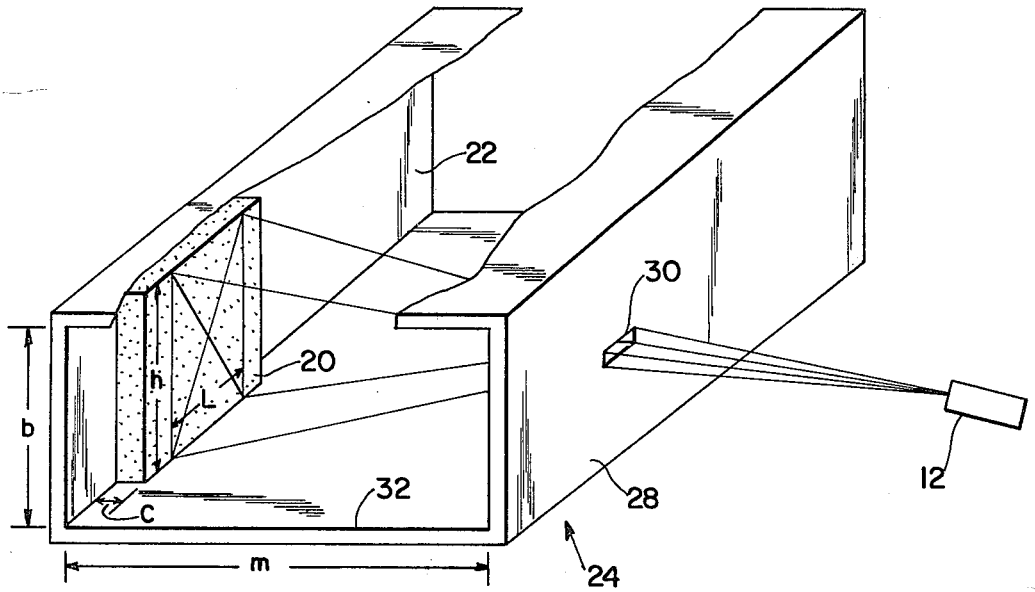

FIG. 3 shows a third embodiment of the present invention which includes a slab 20 of interaction material attached to the internal side of preferably a narrow-dimensioned wall 22 of a metal waveguide 24, and a source 12 of light. The waveguide wall 28 which is opposite to the wall 22 coupled to the slab 20 includes a hole 30 through which light from the light source 12 passes and strikes the slab. The height h of the slab 20 is the same as the height b of the internal narrow-dimensioned wall 22 of the waveguide 24. The thickness c of the slab 20 is small in comparison to the width m of the broad-dimensioned wall 32 of the waveguide 24, that is, $c \leqq m/10$, and may be adjusted for optimum performance.

In all three embodiments the interaction material must absorb the light from the source and thereby form a plasma of electron-hole pairs which decreases the resistivity of the material. A preferred material is high-resistivity, (that is, approximately equal to or greater than 10 ohm-centimeters) semiconductor material, preferably covalently bonded semiconductor material, such as silicon or germanium. The source of light may be any type, such as an injection laser, that produces light having a wavelength approximately equal to or slightly more than the optical absorption edge, that is, the wavelength at which light begins to be significantly absorbed, of the interaction material. The greater the wavelength of the light in comparison to the absorption edge of the material, the less the penetration of light through the material. Any conventional medium, such as air, vacuum, lens, fiber bundle, or optical waveguide, may be used to transmit light from the source to the material.

The portion L of interaction material illuminated by the light is adjustable in all three embodiments, as further explained hereinafter, but for maximum efficiency the light should illuminate the material along the entire h direction.

In the first embodiment shown in FIG. 1, the light penetrates about ten percent or less of the material for maximum efficiency. The penetration depth of the light can be adjusted by selectively matching the wavelength of the light to the optical absorption edge of the material, as previously explained. In the second and third embodiments, shown in FIGS. 2 and 3 respectively, the light penetrates the entire depth of the material for optimum phase-shifting performance.

In operation, electromagnetic radiation having a wave number $k_Z$ propagates through the waveguide. Light from the source strikes an adjustable portion L of the interaction material and forms a plasma of electron-hole pairs in that portion of the material. This optical formation of electron-hole plasma decreases the resistivity of the material and alters the boundary conditions of the waveguide, and therefore changes the wave number of the wave within the volume of the waveguide at the location of the plasma. The radiation interacts with the electron-hole pairs so that the speed of propagation of the radiation changes in the volume of the waveguide in the region of the plasma, in which region the wave number of the radiation is $k_Z'$. The resulting phase shift $\phi_{ps}$ of the radiation is given by $\phi_{ps} \approx (k_Z' - k_Z)\,L$.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. An optically variable phase shifter comprising:
a source of light; and
a waveguide having broad and narrow wall dimensions measured in a plane transverse to the direction of electromagnetic wave propagation therethrough, said waveguide consisting essentially of an interaction material having an optical absorption edge not greater than the wavelength of said light, said material being of a type which forms a plasma of electron-hole pairs when illuminated by said source of light, said plasma decreasing the resistivity of said interaction material and thereby changing the wave number of the wave for altering the speed at which said wave propagates in the waveguide.

2. A phase shifter as recited in claim 1, wherein said interaction material comprises semiconductor material.

3. A phase shifter as recited in claim 2, wherein said semiconductor material is of resistivity approximately equal to or greater than ten ohm-centimeters.

4. A phase shifter as recited in claim 2, wherein said light penetrates approximately ten percent or less of said semiconductor material.

5. A phase shifter as recited in claim 3, wherein said semiconductor material is selected from the group consisting of covalently bonded semiconductors.

6. A phase shifter as recited in claim 5, wherein said covalently bonded semiconductors are selected from the group consisting of silicon and germanium.

7. An optically variable phase shifter comprising:
a source of light; and
a waveguide having broad and narrow wall dimensions measured in a plane transverse to the direction of electromagnetic wave propagation therethrough, said waveguide including a film of interaction material attached to an external broad-dimensioned wall of said waveguide, said interaction material having an optical absorption edge not greater than the wavelength of said light, said material being of a type which forms a plasma of electron-hole pairs when illuminated by said source of light, said plasma decreasing the resistivity of said interaction material and thereby changing the wave number of the wave for altering the speed at which said wave propagates in the waveguide.

8. A phase shifter as recited in claim 7, wherein said waveguide is formed from a dielectric material and said film of interaction material is formed from semiconductor material, the permittivity of the dielectric being approximately equal to the permittivity of the semiconductor.

9. A phase shifter as recited in claim 8, wherein said semiconductor material is of resistivity approximately equal to or greater than ten ohm-centimeters.

10. A phase shifter as recited in claim 8, wherein the thickness of said film of semiconductor material is approximately ten percent or less of the thickness of the narrow dimension of said dielectric waveguide, and said light penetrates the entire thickness of the film of semiconductor material.

11. A phase shifter as recited in claim 9, wherein said semiconductor material is selected from the group consisting of covalently bonded semiconductors.

12. A phase shifter as recited in claim 11, wherein said covalently bonded semiconductors are selected from the group consisting of silicon and germanium.

13. An optically variable phase shifter comprising:

a source of light; and a metal waveguide having broad and narrow wall dimensions measured in a plane transverse to the direction of electromagnetic wave propagation therethrough, said waveguide having semiconductor material attached to an internal narrow-dimensional wall of said waveguide, a narrow-dimensional wall of said waveguide being opposite to the wall to which said material is attached and having an opening through which light may pass for illuminating said material, the material having an optical absorption edge not greater than the wavelength of said light, said material being of a type which forms a plasma of electron-hole pairs when illuminated by said source of light, the material having a thickness of approximately ten percent or less of the broad dimension of said waveguide, said light penetrating the entire thickness of the material, said plasma decreasing the resistivity of said material and thereby changing the wave number of the wave for altering the speed at which said wave propagates in the waveguide.

* * * * *